US007334710B2

(12) United States Patent
Semenenko

(10) Patent No.: US 7,334,710 B2
(45) Date of Patent: Feb. 26, 2008

(54) CLOSURE ASSEMBLIES FOR STORES OF FLOWABLE MATERIAL

(76) Inventor: Ivan Semenenko, Wolford Lodge, Great Wolford Road, Moreton-in-Marsh, Gloucestershire (GB) GL56 0PE ( * ) Notice: Subject to any disclaimer, the term of this patent is extended or adjusted under 35 U.S.C. 154(b) by 466 days.

(21) Appl. No.: 10/924,937

(22) Filed: Aug. 25, 2004

(65) Prior Publication Data

US 2005/0045670 A1 Mar. 3, 2005

(30) Foreign Application Priority Data

Sep. 3, 2003 (GB) ..... 0320581.2

(51) Int. Cl.
*B65D 45/28* (2006.01)

(52) U.S. Cl. ..... 222/559; 222/181.1; 222/504

(58) Field of Classification Search ..... 222/504, 222/559, 181.1, 181.2, 181.3, 561; 414/200–202, 414/204
See application file for complete search history.

(56) References Cited

U.S. PATENT DOCUMENTS

| | | | | |
|---|---|---|---|---|
| 2,674,382 | A * | 4/1954 | Tesch et al. | 414/201 |
| 3,070,242 | A * | 12/1962 | Berczynski | 414/202 |
| 3,679,192 | A * | 7/1972 | Powell | 414/202 |
| 5,118,242 | A | 6/1992 | Ebert et al. | |
| 5,385,437 | A | 1/1995 | Lonardi et al. | 414/204 |
| 5,775,544 | A | 7/1998 | Semenenko et al. | 222/504 |
| 6,568,568 | B1 * | 5/2003 | Piepereit | 222/185.1 |
| 6,623,013 | B1 * | 9/2003 | Lee | 277/628 |

FOREIGN PATENT DOCUMENTS

| | | |
|---|---|---|
| GB | 0685371 | 1/1953 |
| GB | 2348636 | 10/2000 |
| GB | 2 377 926 | 1/2003 |
| WO | WO 99/64767 | 12/1999 |

* cited by examiner

*Primary Examiner*—J. Casimer Jacyna
(74) *Attorney, Agent, or Firm*—Young & Thompson

(57) ABSTRACT

The closure assembly comprises a first closure device in the form of a cone valve typically having a downwardly diverging upper surface and a second closure device in the form of a plug which is vertically slidable relative to the first closure device so that when in use the closure assembly is opened by a closure operating member acting on the plug, the plug will move upwardly from a closed to an open condition while the cone valve remains in a closed condition and subsequently the cone valve will move upwardly from its closed to an open condition. The cone valve comprises first and second parts, the first part being more flexible than the second part and being arranged to adopt a closed position relative to the store prior to the second part adopting a closed position relative to the store during a closing operation of the closure assembly.

7 Claims, 2 Drawing Sheets

CLOSURE ASSEMBLIES FOR STORES OF FLOWABLE MATERIAL

INTRODUCTION

This invention relates to a closure assembly for a store of flowable material, such as a silo or an intermediate bulk container, and to a store equipped with such a closure assembly.

It is well known, e.g. from GB-A-2348636, to provide a closure device in the form of a cone valve to close a discharge opening of a store (such as a hopper) of flowable material. However, particulate material in the form of tablets, granules, pellets and the like, can jam the cone valve open or can be compressed by the cone valve thereby disintegrating. This is particularly disadvantageous in the case of pharmaceutical products.

SUMMARY OF THE INVENTION

According to a first aspect of the present invention, there is provided a closure assembly for a store of flowable material, comprising a first closure device and a second closure device which is vertically slidable relative to the first closure device so that when in use the closure assembly is opened by a closure operating member acting on the second closure device, the second closure device will move upwardly from a closed to an open condition while the first closure device remains in a closed condition and subsequently the second closure device will move upwardly from its closed to an open condition.

Preferably, the first closure device comprises first and second parts, the first part being more flexible than the second part and being arranged to adopt a closed position relative to the store prior to the second part adopting a closed position relative to the store during a closing operation of the closure assembly.

Preferably, the first closure device has a downwardly diverging upper surface and is typically of conical shape.

Advantageously, the first closure device has an elongate guide member depending therefrom and the second closure device has a bore in which the elongate guide member is slidable.

According to a second aspect of the present invention there is provided a store of flowable material having a closure assembly according to the first aspect of the present invention and a discharge opening closable by the closure assembly.

The store may be in the form of a silo or of an intermediate bulk container.

The invention will now be more particularly described, by way of example, with reference to the accompanying drawings.

DESCRIPTION OF THE PREFERRED EMBODIMENTS

Figure 1:
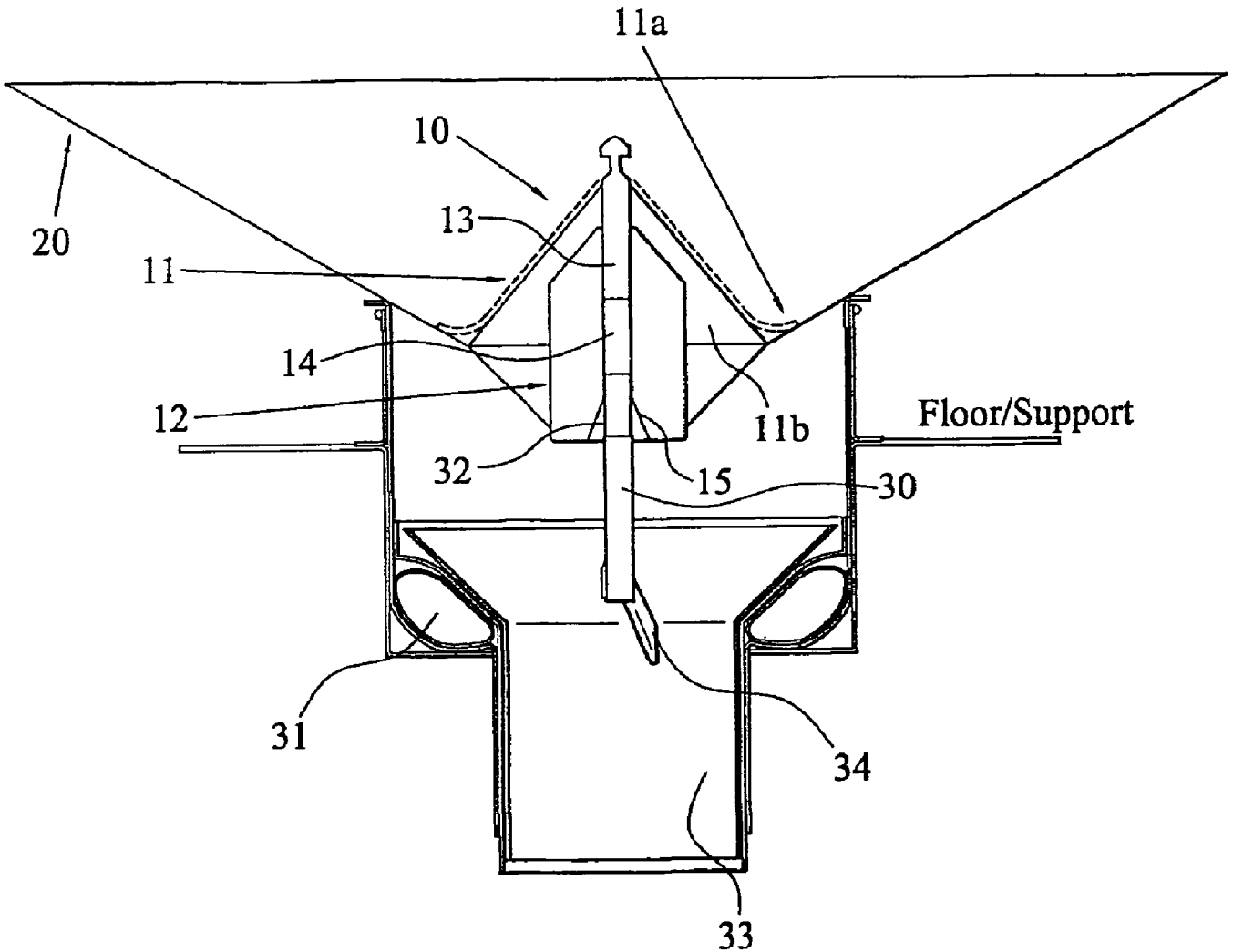
FIG. 1 is a sectional view through one embodiment of a closure assembly according to the present invention, together with a store having a discharge opening closable by the closure assembly and an operating member for opening and closing the closure assembly.

Referring firstly to FIG. 1, the closure assembly 10 shown therein is intended to close the discharge opening of a store 20 of flowable particulate material, such as a silo or an intermediate bulk container containing particulate material such as tablets, granules or pellets. The closure assembly 10 is operated by a closure operating member 30 movable upwardly by an actuator 31.

The closure assembly 10 comprises a first closure device 11 which is in the form of a cone valve having a conical upper surface and a second closure device 12 which is vertically slidable relative to the first closure device 11 and which is in the form of a plug.

The first closure device 11 comprises first and second parts 11*a* and 11*b*. The first part 11*a* is more flexible than the second part 11*b* and is typically formed of rubber or flexible plastics material. The second part 11*b* is formed of relatively rigid plastics material or steel.

The first part 11*a* lies on top of the second part 11*b* and its lowermost rim extends below the lowermost rim of the second part 11*b* when the closure assembly is in an open condition so that as the closure assembly moves from an open to a closed condition, the first part 11*a* reaches a closed position prior to the second part 11*b* as described hereinafter.

The first closure device 11 has an elongate guide member in the form of a guide rod 13 depending from its apex and this guide rod 13 is slidably received within a bore 14 of the second closure device 12.

The closure operating member 30 is in the form of a probe having a frusto-conical head 32 which mates with a frusto-conical recess 15 at the lower end of the bore 14. The probe 30 is connected to a through flow device 33 by struts 34 and is raised or lowered, together with the through flow device 33, by the actuator 31, which is in the form of a toroidal pneumatic actuator, in a manner more fully described in GB-A-2348636.

Starting from a closed position of the closure assembly, the probe 30 will initially raise the plug 12 and this plug 12 will slide relative to the cone valve 11 until either the plug 12 makes contact with the underside of the cone valve 11 or the probe 30 makes contact with the lower end of the guide rod 13. The cone valve 11 will then be raised together with the plug 12 to fully open the discharge opening of the store.

The closure assembly shown in FIG. 2 is slightly different from that shown in FIG. 1 in that the plug 12 comprises a stem portion 16 which slidably receives the guide rod 13 and a closure portion 17 at the lower end of the stem portion 16.

Figure 2A:
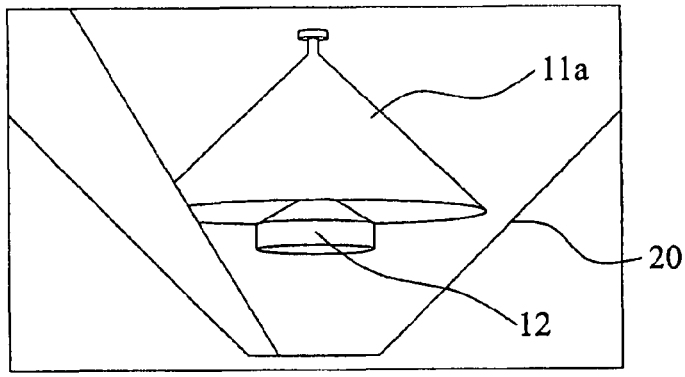
FIGS. 2*a* to 2*d* show the closing sequence of a slightly different embodiment of a closure assembly according to the present invention.
Figure 2B:
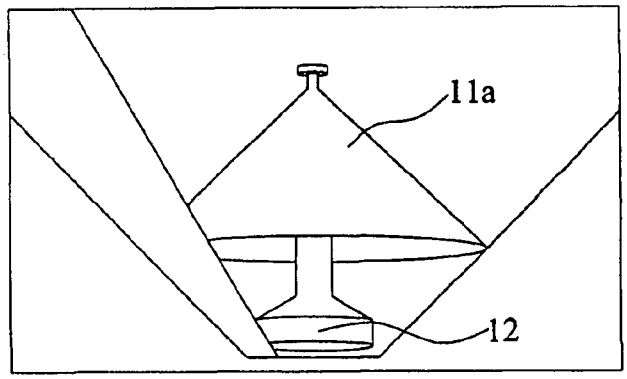
Figure 2C:
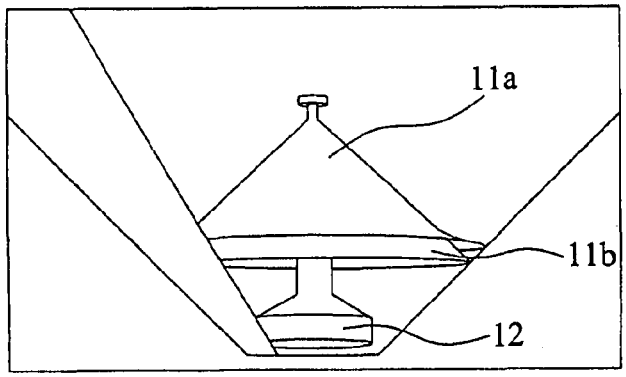
Figure 2D:
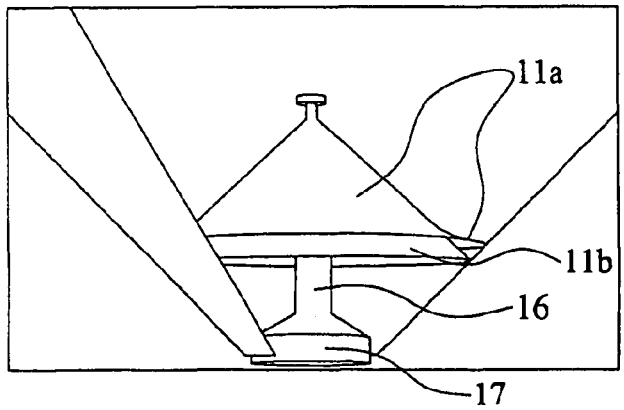

Starting from a fully open condition as shown in FIG. 2*a*, the cone valve 11 will be lowered by the probe (not shown) together with the plug 12. During the lowering operation, the lowermost edge of the first part 11*a* of the cone valve will initially make contact with the frusto-conical inner wall of the store 20. As the probe further lowers the cone valve 11 and the plug 12, the lowermost edge of the first part 11*a* of the cone valve 11 will fold upwards as shown in FIG. 2*c* until the second part 11*b* of the cone valve makes contact with the inner wall of the store 20. When the first part 11*a* makes contact with the wall of the store 20, it will stop any further flow of particulate material so that when the second part 11*b* makes contact with the wall of the store, no particulate material will be crushed. Any remaining particulate material below the cone valve 11 will then drain out prior to the plug 12 plugging the discharge opening at the lowermost end of the store 20 to make a fail safe closure.

The embodiments described above prevent damage to particulate material in the store 20 and also ensure that the closure assembly does not jam partly open. Also, the two part seal provided on the one hand between the cone valve 11 and the wall of the store 20 and on the other hand between the probe and the store will ensure stability of the closure assembly with no tipping or leakage.

In use, the actuator 31 will move the probe 30 upwards to open the closure assembly 10 and can then be operated to pulse the closure assembly upwards and downwards in order to provide a steady flow of particulate material through the discharge opening of the store as more particularly described, for example, in GB-A-2348636.

The embodiments described above are given by way of example only and various modifications will be apparent to persons skilled in the art without departing from the scope of the invention as defined by the appended claims. For example, in certain circumstances, the first closure device 11 could be formed of a single part rather than being of two-part form as described above. Also, it need not be a cone valve.

What is claimed is:

1. A closure assembly for a store of flowable material, comprising a first closure device and a second closure device which is vertically slidable relative to the first closure device so that when in use the closure assembly is opened by a closure operating member acting on the second closure device, the second closure device will move upwardly from a closed to an open condition while the first closure device remains in a closed condition and subsequently the first closure device will move upwardly from its closed to an open condition, wherein the first closure device has an elongate guide member depending therefrom and the second closure device has a bore in which the elongate guide member is slidable.

2. A closure assembly as claimed in claim 1, wherein the first closure device comprises first and second parts, the first part being more flexible than the second part and being arranged to adopt a closed position relative to the store prior to the second part adopting a closed position relative to the store during a closing operation of the closure assembly.

3. A closure assembly as claimed in claim 1, wherein the first closure device has a downwardly diverging upper surface.

4. A closure assembly as claimed in claim 3, wherein the first closure device is of conical shape.

5. A store of flowable material having a closure assembly comprising a first closure device and a second closure device which is vertically slidable relative to the first closure device so that when in use the closure assembly is opened by a closure operating member acting on the second closure device, the second closure device will move upwardly from a closed to an open condition while the first closure device remains in a closed condition and subsequently the first closure device will move upwardly from its closed to an open condition, and a discharge opening closable by the closure assembly, wherein the first closure device has an elongate guide member depending therefrom and the second closure device has a bore in which the elongate guide member is slidable.

6. A store as claimed in claim 5, in the form of a silo.

7. A store as claimed in claim 5, in the form of an intermediate bulk container.

* * * * *